US009420382B2

(12) United States Patent
Jespersgaard

(10) Patent No.: US 9,420,382 B2
(45) Date of Patent: Aug. 16, 2016

(54) BINAURAL SOURCE ENHANCEMENT

(71) Applicant: Oticon A/S, Smørum (DK)

(72) Inventor: Claus Forup Corlin Jespersgaard, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 14/598,077

(22) Filed: Jan. 15, 2015

(65) Prior Publication Data

US 2015/0201287 A1 Jul. 16, 2015

(30) Foreign Application Priority Data

Jan. 16, 2014 (EP) ..... 14151380

(51) Int. Cl.
*H04R 25/00* (2006.01)

(52) U.S. Cl.
CPC ..... *H04R 25/50* (2013.01); *H04R 25/407* (2013.01); *H04R 25/552* (2013.01); *H04R 25/554* (2013.01); *H04R 2225/43* (2013.01)

(58) Field of Classification Search
CPC ..... H04R 25/407; H04R 25/43; H04R 25/55; H04R 5/552; H04R 2225/41; H04R 2225/43; H04R 2225/53; H04R 2225/55; H04R 25/552; H04R 25/453
USPC ..... 381/23.1, 313, 315, 317, 320, 321, 91, 381/92, 94.1
See application file for complete search history.

(56) References Cited

U.S. PATENT DOCUMENTS 5,434,924 A * 7/1995 Jampolsky ..... 381/23.1
6,549,633 B1 * 4/2003 Westermann ..... H04R 25/453 381/312

(Continued)

FOREIGN PATENT DOCUMENTS

WO WO 2008/006401 A1 1/2008

OTHER PUBLICATIONS

Roman et al., "Speech segregation based on sound localization", Acoustical Society of America, 2003, vol. 114, No. 4, pp. 2236-2252.

(Continued)

*Primary Examiner* — Huyen D Le
(74) *Attorney, Agent, or Firm* — Birch, Stewart, Kolasch & Birch, LLP

(57) ABSTRACT

The present invention regards a binaural hearing system comprising a first hearing device and a second hearing device. Each of the hearing devices comprises a power source, an environment sound input, a link unit and electric circuitry. The environment sound input is configured to receive sound from an acoustic environment and to generate an environment sound signal. The link unit is configured to transmit the environment sound signal from the hearing device comprising the link unit to a link unit of the other hearing device of the binaural hearing system and to receive a transmitted environment sound signal from the other hearing device. The electric circuitry of each of the hearing devices is configured to process and environment sound signals and transmitted environment sound signals and to estimate a respective time delay between the environment sound signal and the transmitted environment sound signal based on the corresponding processed signals. The electric circuitry is configured to apply the respective time delay to the transmitted environment sound signal to generate a time delayed transmitted environment sound signal. The electric circuitry is configured to subtract the equalized (at least time delayed) transmitted environment sound signal from the environment sound signal to receive an equalized-cancelled environment sound signal, and to determine a target signal and/or a noise signal based thereon.

19 Claims, 6 Drawing Sheets

(56) References Cited

U.S. PATENT DOCUMENTS

| | | | | |
|---|---|---|---|---|
| 2009/0304203 | A1 | 12/2009 | Haykin et al. | |
| 2010/0135500 | A1* | 6/2010 | Derleth et al. | 381/23.1 |
| 2010/0172506 | A1* | 7/2010 | Iwano | 381/23.1 |

OTHER PUBLICATIONS

Durlach et al. "Equalization and Cancellation Theory of Binaural Masking-Level Differences", The Journal of the Acoustical Society of America, vol. 35, No. 8 (1963).

Kim et al., "Binaural Sound Source Separation Motivated by Auditory Processing", Proc. ICASSP, pp. 5072-5075 (2011).

Li et al., "Two-Stage Binaural Speech Enhancement with Wiener Filter Based on Equalization-Cancellation Model", IEEE WASPAA, pp. 133-136 (2009).

Li et al., "Two-stage Binaural Speech Enhancement with Wiener Filter for High-Quality Speech Communication", Speech Communication 53, pp. 677-689 (2011).

* cited by examiner

BINAURAL SOURCE ENHANCEMENT

The present disclosure regards a binaural hearing system comprising a left hearing device, a right hearing device, and a (communication) link between the two hearing devices and a method for operating a binaural hearing system.

Hearing devices generally comprise a microphone, a power source, electric circuitry and an output unit, e.g. a speaker (receiver). Binaural hearing systems typically comprise two hearing devices, one for a left ear and one for a right ear of a listener. The sound received by a listener through his ears often consists of a complex mixture of sounds coming from all directions. The healthy auditory system possesses a remarkable ability to separate the sounds originating from different sources. Furthermore, normal-hearing (NH) listeners have an amazing ability to follow the conversation of a single speaker in the presence of others, a phenomenon known as the "cocktail-party problem".

The single most common complaint among people with hearing loss is the difficulty in understanding speech in complex acoustic environments, such as background noise, reverberation or competing talkers. Although compensating for the reduced sensitivity (e.g., by hearing aids) largely improves the ability to understand speech in quiet and to some extent in noisy environments many hearing-impaired (HI) listeners still show great difficulties in adverse conditions.

Normal-hearing (NH) listeners can use Interaural Time Difference (ITD), the difference in arrival time of a sound between the two ears, and Interaural Level Difference (ILD), the difference in level of a sound between the two ears caused by shadowing of the sound by the head, to cancel sounds in the left ear which are coming from the right side of the listener and sounds in the right ear which are coming from the left side of the listener. This phenomenon is called binaural Equalization-Cancellation (EC) and was first described in "Equalization and Cancellation Theory of Binaural Masking-Level Differences", N. I. Durlach, J. Acoust. Soc. Am. 35, 1206 (1963). The result of this is that the signal-to-noise ratio (SNR) of the right source is improved in the right ear while the SNR of the left source is improved in the left ear. Accordingly, the listener can select which source to attend to. Normal-hearing (NH) listeners can do this rather effectively, while hearing-impaired (HI) listeners often have problems doing this, leading to significantly reduced speech intelligibility in adverse conditions.

C. Kim, K. Kumar, and R. M. Stern, "Binaural sound source separation motivated by auditory processing", Proc. ICASSP, pp. 5072-5075 (2011) presents a method of signal processing for speech recognition using two microphones. Speech signals detected by two microphones are passed through bandpass filtering in a filter bank. Interaural cross-correlation is used to generate a spatial masking function. The spatial masking function and a temporal mask are combined and applied on the speech signals.

J. Li, S. Sakamoto, S. Hongo, M. Akagi, and Y. Suzuki, "Two-stage binaural speech enhancement with Wiener filter based on equalization-cancellation model", in Proc. IEEE WASPAA, 2009, pp. 133-136 shows a method for binaural speech enhancement. The method is based on the equalization-cancellation (EC) model. In a first stage interfering signals are estimated by equalizing and cancelling a target signal based on the EC model. A time-variant Wiener filter is applied to enhance the target signal given noisy mixture signals in a second stage.

In J. Li, S. Sakamoto, S. Hongo, M. Akagi, and Y. Suzuki, "Two-stage binaural speech enhancement with Wiener filter for high-quality speech communication", Speech Commun. 53, pp. 677-689 (2011) a two-input two-output system for speech communication is presented. The system comprises a two-stage binaural speech enhancement with Wiener filter approach. In a first stage interference signals are estimated by equalization and cancellation processes for a target signal. The cancellation is performed for interference signals. In a second stage a time-variant Wiener filter is applied to enhance the target signal given noisy mixture signals.

WO 2004/114722 A1 presents a binaural hearing aid system with a first and second hearing aid, each comprising a microphone, an A/D converter, a processor, a D/A converter, an output transducer, and a binaural sound environment detector. The binaural sound environment detector determines a sound environment surrounding a user of the binaural hearing aid system based on at least one signal from the first hearing aid and at least one signal from the second hearing aid. The binaural sound environment determination is used for provision of outputs for each of the first and second hearing aids for selection of the signal processing algorithm of each of the hearing aid processors. This allows the binaural hearing aid system to perform coordinated sound processing.

It is an object of the disclosure to provide an improved binaural hearing system and an improved method for processing binaural sound signals.

This object is achieved by a binaural hearing system comprising a first hearing device and a second hearing device. Each of the hearing devices comprises a power source, an output transducer, an environment sound input, a link unit and electric circuitry. The environment sound input is configured to receive sound from an acoustic environment and to generate an environment sound signal. The link unit is configured to transmit the environment sound signal from the hearing device comprising the link unit to a link unit of the other hearing device of the binaural hearing system and to receive a transmitted environment sound signal from the other hearing device of the binaural hearing system. The electric circuitry may comprise a filter bank. The filter bank is configured to process the environment sound signal and the transmitted environment sound signal by generating processed environment sound signals and processed transmitted environment sound signals. Each of the processed environment sound signals and processed transmitted environment sound signals corresponds to a frequency channel determined by the filter bank. The electric circuitry of each of the hearing devices is configured to use the environment sound signals and/or the processed environment sound signals of the respective hearing device and the transmitted environment sound signals and/or the processed transmitted environment sound signals from the other hearing device to estimate a respective time delay between the environment sound signal and the transmitted environment sound signal. The electric circuitry is configured to apply the respective time delay to the transmitted environment sound signal to generate a time delayed transmitted environment sound signal. The time delays estimated in the respective hearing devices using the processed environment sound signal of the respective hearing device and the processed transmitted environment sound signal of the other hearing device can be different, e.g., as the shadowing effect of the head can depend on the sound source location and on degree of symmetry of a head between the hearing devices.

In an embodiment, the respective time delays are estimated from the respective environment sound signal and transmitted environment sound signal (or signals derived therefrom) in the time domain (as opposed to the time-frequency domain), without the use of a filter bank.

In an embodiment, the time delays incurred by the processing (including transmission, reception) of the environment sound signals and the transmitted environment sound signals are compensated for to provide that a comparison of the respective environment sound signal and transmitted environment sound signal is not biased by processing delays of the respective signals (but reflect the difference in arrival time of a sound between the two ears (hearing devices)).

In an embodiment, the electric circuitry is configured to scale the time delayed transmitted environment sound signal by a respective interaural level difference to generate an equalized transmitted environment sound signal. The electric circuitry is configured to subtract the equalized (at least time delayed, and optionally scaled), transmitted environment sound signal from the environment sound signal to receive an equalized-cancelled environment sound signal. Thereby, the first hearing device determines sound primarily having its origin in a first half plane or space (including the first hearing device) and the second hearing device determines sound primarily having its origin in a second half plane or space (including the second hearing device).

In an embodiment, the electric circuitry is configured to use the equalized-cancelled environment sound signal to generate an output sound signal, which can be converted into an output sound by the output transducer. Each of the hearing devices generates a respective equalized-cancelled environment sound signal, which can be used to generate a respective output sound signal. In an embodiment, the output sound signals of the first and second hearing devices are based on the equalized-cancelled environment sound signals generated in the first and second hearing devices (e.g. by converting the equalized-cancelled environment sound signals directly to respective output sounds or by denying parameters from the equalized-cancelled environment sound signals, which parameters are used to determine the respective output sound signals of the first and second hearing devices). The respective equalized-cancelled environment sound signals, the respective output sound signals and therefore also the output sounds can be different for each of the hearing devices.

One aspect of the disclosure is the improvement of left environment sound signals in the right ear and right environment sound signals in the left ear when in use in a binaural hearing system comprising a left hearing device worn at the left ear and a right hearing device worn at the right ear. Another aspect of the disclosure is an increase of intelligibility for hearing impaired (HI) listeners, who are not able to perform this task without a binaural hearing system.

The electric circuitry can comprise processing units, which can perform one, some or all of the tasks (signal processing) of the electric circuitry. Preferably, the electric circuitry comprises a time delay estimation unit configured to use the processed environment sound signals of the respective hearing device and the processed transmitted environment sound signals from the other hearing device to estimate a respective time delay between the environment sound signal and the transmitted environment sound signal. In one embodiment, the electric circuitry comprises a time delay application unit configured to apply the respective time delay to the transmitted environment sound signal to generate a time delayed transmitted environment sound signal. In one embodiment, the electric circuitry comprises an interaural level difference scaling unit configured to scale the time delayed transmitted environment sound signal by a respective interaural level difference to generate an equalized transmitted environment sound signal. The interaural level difference scaling can optionally be used to scale target or masking components of an environment sound signal. Masking components are noise components which decrease the signal quality and target components are signal components which increase the signal quality. In one embodiment, the electric circuitry comprises a subtraction unit configured to subtract the equalized transmitted environment sound signal from the environment sound signal to receive an equalized-cancelled environment sound signal. In one embodiment, the electric circuitry comprises an output signal generation unit which is configured to use the equalized-cancelled environment sound signal to generate an output sound signal, which can be converted into an output sound by the output transducer.

In a preferred embodiment, the filter banks of the electric circuitry comprise a number of band-pass filters. The band-pass filters are preferably configured to divide the environment sound signal and transmitted environment sound signal into a number of environment sound signals and transmitted environment sound signals each corresponding to a frequency channel determined by one of the band-pass filters. The band-pass filters preferably each generate a copy of the respective signal and perform band-pass filtering on the copy of the respective signal. Each band-pass filter has a predetermined center frequency and a predetermined frequency bandwidth which correspond to a frequency channel. The band-pass filter (ideally) passes only frequencies within a certain frequency range defined by the center frequency and the frequency bandwidth. Frequencies outside the frequency range defined by the center frequency and the frequency bandwidth of the band-pass filter are removed (or attenuated) by the band-pass filtering. The center frequencies of the band-pass filters may be distributed in any manner depending on the application, e.g. linearly or non-linearly, e.g. logarithmically, but are preferably linearly spaced according to an Equivalent Rectangular Bandwidth (ERB) scale. The center frequencies of the band-pass filters are between a minimum and maximum frequency of operation of the hearing device, e.g. in a frequency range including a typical frequency range of speech, preferably between 0 Hz and 8000 Hz, e.g. between 100 Hz and 2000 Hz, such as between 100 Hz and 600 Hz. The fundamental frequency of voices or speech of individuals can have a broad range with high fundamental frequencies for women and children with up to 600 Hz. The fundamental frequencies of interest are those below approximately 600 Hz, preferably below approximately 300 Hz including speech modulations and pitch of voiced speech.

Preferably, the electric circuitry of each of the hearing devices comprises a rectifier. The rectifier is preferably configured to half-wave rectify respective sound signals of each of the frequency channels. The rectifier can also be configured to rectify a respective incoming (full band) sound signal.

Preferably, the electric circuitry of each of the hearing devices comprises a low-pass filter. The low-pass filter is preferably configured to low-pass filter respective sound signals of each of the frequency channels. Low-pass filtering here means that amplitudes of signals with frequencies above a cut-off frequency of the low-pass filter are removed (or attenuated) and low-frequency signals with a frequency below the cut-off frequency of the low-pass filter are passed.

Preferably, each of the electric circuitries is configured to generate a processed environment sound signal and a processed transmitted environment sound signal in each of the frequency channels by using the filter bank, the rectifier, and the low-pass filter. Each of the electric circuitries can also be configured to use only the filter bank or the filter bank and the rectifier or the filter bank and the low-pass filter to generate a processed environment sound signal and a processed transmitted environment sound signal in each of the frequency channels.

In an embodiment, the hearing device comprises an analogue-to-digital (AD) converter to digitize an analogue (audio) input with a predefined sampling rate $f_s$, e.g. 20 kHz, to provide digital (audio) samples $x_n$ (or x[n], of duration $T_s=1/f_s$) at discrete points in time $t_n$ (or n), each (audio) sample representing the value of a signal at $t_n$ by a predefined number $N_s$ of bits, $N_s$ being e.g. in the range from 1 to 16 bits. In an embodiment, a number of (audio) samples (e.g. $N_s=64$) are arranged in a time frame (of length in time $T_F=N_F*T_s$, e.g. $T_F=64/20\ 10^{-3}$ s=3.2 ms). In an embodiment, the hearing device comprises a digital-to-analogue (DA) converter to convert a digital signal to an analogue output signal, e.g. for being presented to a user via an output transducer.

In an embodiment, the electric circuitry of each of the hearing devices is configured to determine a cross-correlation function between the environment sound signals and the transmitted environment sound signals and to determine a time delay therefrom (e.g. as the lag of the first peak of the cross-correlation function). In one embodiment, the electric circuitry of each of the hearing devices is configured to determine a cross-correlation function between the processed environment sound signals and the processed transmitted environment sound signals of each of the frequency channels. The cross-correlation function can be determined on a (time) frame base (frame based cross-correlation) or continuously (running cross-correlation). Preferably, all cross correlation functions are summed and a time delay is estimated from the peak with smallest lag or as the lag of the largest peak of the summed cross-correlation functions. Alternatively, the time delay of each frequency channel can also be estimated as the peak with smallest lag or as the lag of the largest peak. A time delay between the environment sound signals and the transmitted environment sound signals can then be determined by averaging the time delays of each frequency channel across all frequency channels. The electric circuitry of one of the respective hearing devices can also be configured to determine the time delay with a different method than the electric circuitry of the other hearing device.

A respective time delay determined in the first hearing device can be different from a respective time delay determined in the second hearing device, as the first hearing device determines the respective time delay based on sound coming from a second half plane and the second hearing device determines the respective time delay based on sound coming from a first half plane. To understand the half planes we consider a head wearing the first and second hearing device on two sides of the head. A first sound source is located on a first side of the head, representing the first half plane (or space) and a second sound source is located on a second side of the head, representing the second half plane (or space). Therefore, e.g., a shadowing effect by a head can be different for the two hearing devices, and also the location of sound sources is typically not symmetric. This can lead to different time delays between the environment sound signal and the transmitted environment sound signal in the first hearing device and second hearing device.

In a preferred embodiment, the electric circuitry of each of the hearing devices comprises a lookup table with a number of predetermined scaling factors. Each of the predetermined scaling factors represent an interaural level difference, which preferably corresponds to a time delay range or time delay. The lookup tables with predetermined scaling factors can be different for each of the hearing devices, e.g., the predetermined scaling factors can be different and/or the lookup table time delay ranges or time delays can be different for the lookup tables. The predetermined scaling factors can be determined in a fitting step to determine the respective interaural level and/or time difference of sound between the two hearing devices of the binaural hearing system, preferably when the hearing devices are worn by the user (to provide customized scaling factors (ILDs)). Alternatively, some standard predetermined scaling factors can be used, which are preferably determined in a standard setup with a standard head and torso simulator (HATS). The interaural level difference can also be determined from the processed environment sound signals and the processed transmitted environment sound signals using the determined time delays. The interaural level difference can be determined for target sound or masking sound or sound comprising both target and masking sound in dependence of the predetermined scaling factors. Preferably, the predetermined scaling factors are determined such that the interaural level difference of masking sound is determined. The interaural level difference results from the difference in sound level of sound received by the two hearing devices due to a different distance to the sound source and a possible shadowing effect of a head between the hearing devices of a binaural hearing system. The respective interaural level difference is preferably determined by the respective lookup table in dependence of the respective time delay between the environment sound signal and the transmitted environment sound signal.

In an embodiment, the first hearing device determines the respective interaural level difference based on sound coming from a second half plane and the second hearing device determines the respective interaural level difference based on sound coming from a second half plane.

In a preferred embodiment the electric circuitry of each of the hearing devices is configured to delay and attenuate the transmitted environment sound signal with the time delay and interaural level difference determined by the hearing device and subtract this resulting signal from the environment sound signal of the hearing device to generate a equalized-cancelled environment sound signal.

In an embodiment, the electric circuitry of each of the first and second hearing devices is configured to (dynamically) determine a (current) target and/or a noise signal based on the equalized-cancelled first and second environment sound signals (or signals derived therefrom). In an embodiment, the electric circuitry of each of the first and second hearing devices is configured to (dynamically) determine a (current) target and/or a noise signal from a pitch and a pitch strength of the equalized-cancelled first and second environment sound signals (or signals derived therefrom). In an embodiment, a (current) target and/or a noise signal is determined based on analysis of the equalized-cancelled first and second environment sound signals in the frequency domain, e.g. in a number of frequency bands or channels.

In a preferred embodiment, the filter bank (or a processor operationally connected to the filter bank) of the electric circuitry (or another filter bank) of each of the hearing devices of the binaural hearing system is configured to process the equalized-cancelled environment sound signal by generating processed equalized-cancelled environment sound signals. Each of the processed equalized-cancelled environment sound signals corresponds to a frequency channel determined by the filter bank. The electric circuitry of each of the hearing devices is preferably configured to determine an auto-correlation function of the processed equalized-cancelled environment sound signals in each frequency channel. The auto-correlation function is preferably determined in short time frames or by using a sliding window (e.g. in the ms range). The electric circuitry of each of the hearing devices is preferably configured to determine a summed auto-correlation function of the processed equalized-cancelled environment sound signals of each frequency channel by summing the auto-correlation function of the processed equalized-cancelled environment sound signals of each frequency channel across all frequency channels as a function of time, e.g. at each time step. The time steps result from the duration of the short time frames or from a predefined time step of the sliding window. The electric circuitry of each of the hearing devices is preferably configured to determine a pitch from a lag of a largest peak in the summed auto-correlation function and to determine the pitch strength by the peak-to-valley ratio of the largest peak. The electric circuitry of each of the hearing devices is preferably configured to provide the pitch and pitch strength to the link unit of the respective hearing device. The link unit is preferably configured to transmit the pitch and pitch strength to the link unit of the other hearing device of the binaural hearing system and to receive the pitch and pitch strength from the other hearing device. Alternatively, the electric circuitry of each of the hearing devices can also be configured to provide the summed auto-correlation function to the link unit of the respective hearing device. In this case, the link unit can be configured to transmit the summed auto-correlation to the link unit of the other hearing device of the binaural hearing system and to receive a transmitted summed auto-correlation function from the other hearing device. The electric circuitry of each of the hearing devices can then be configured to determine a pitch from a lag of a largest peak in the summed auto-correlation function and the transmitted summed auto-correlation function and to determine the pitch strength by the peak-to-valley ratio of the largest peak.

Preferably, each of the electric circuitries is configured to compare the pitches of the equalized-cancelled environment sound signals of both hearing devices to determine a strongest and/or weakest pitch. A target signal can be determined as the processed equalized-cancelled environment sound signal or the processed transmitted equalized-cancelled environment sound signal with the strongest pitch by the electric circuitry of each of the hearing devices. Preferably, each of the electric circuitries is configured to provide the target signal to the link unit of the respective hearing device. Each of the link units is preferably configured to transmit the target signal to the link unit of the other hearing device.

Alternatively, the equalized-cancelled environment sound signal of a respective hearing device can be transmitted to the other hearing device and a transmitted equalized-cancelled environment sound signal can be received by the respective hearing device from the other hearing device, such that both hearing devices contain an equalized-cancelled environment sound signal and a transmitted equalized-cancelled environment sound signal.

A noise signal can be determined as the equalized-cancelled environment sound signal or transmitted equalized-cancelled environment sound signal with the weakest pitch by the electric circuitry of each of the hearing devices. In other words, the noise signal is defined as the one of the equalized-cancelled environment sound signal and the transmitted equalized-cancelled environment sound signal that is NOT identified as the target signal.

In another preferred embodiment each of the electric circuitries is configured to process the equalized-cancelled environment sound signal by generating processed equalized-cancelled environment sound signals in each of the frequency channels by using the filter bank, the rectifier, and the low-pass filter. Each of the electric circuitries can also be configured to use only the filter bank or the filter bank and the rectifier or the filter hank and the low-pass filter to generate a processed equalized-cancelled environment sound signal in each of the frequency channels. The filter bank is configured to process the equalized-cancelled environment sound signal in an equivalent way to the environment sound signal and the transmitted environment sound signal. The processed equalized-cancelled environment sound signals of the frequency channels of the two hearing devices can be used to determine a target signal and a noise signal. Preferably, the pitch and pitch strengths of the processed equalized-cancelled environment sound signals are determined and transmitted to the other hearing device to determine a target signal and a noise signal. Alternatively, the processed equalized-cancelled environment sound signals can be transmitted to the other hearing device to determine a target signal and a noise signal.

In a preferred embodiment the electric circuitry of each of the hearing devices is configured to apply the respective time delay to the target signal. The electric circuitry can also be configured to scale the target signal by a respective interaural level difference. Preferably the electric circuitry is further configured to generate an output sound signal by applying the respective time delay to the target signal and/or scaling the target signal received from the other hearing device. As an example we consider a situation with a left hearing device, respectively a first hearing device and right hearing device, respectively a second hearing device. If the target signal is the equalized-cancelled environment sound signal of the right hearing device, the target signal is transmitted to the left hearing device, where it is time delayed according to a time delay determined in the left hearing device and scaled according to an interaural level difference determined in the left hearing device. The target signal of the right hearing device is the output sound signal in the right hearing device and the transmitted time delayed and scaled target signal is the output sound signal in the left hearing device. If the target signal is the equalized-cancelled environment sound signal of the left hearing device the target signal is transmitted to the right hearing device, where it is time delayed according to a time delay determined in the right hearing device and scaled according to an interaural level difference determined in the right hearing device. The target signal of the left hearing device is the output sound signal in the left hearing device and the transmitted time delayed and scaled target signal is the output sound signal in the right hearing device. The respective output sound signal can be converted to output sound by an output transducer, e.g., a speaker, a bone anchored transducer, a cochlear implant or the like.

Preferably, the electric circuitry of each of the hearing devices is configured to determine a noise signal as the equalized-cancelled environment sound signal with the weakest pitch. As an example we consider a situation with a left hearing device, respectively a first hearing device and right hearing device, respectively a second hearing device. If the noise signal is the equalized-cancelled environment sound signal of the right hearing device the, noise signal is transmitted to the left hearing device, where it is time delayed according to a time delay determined in the left hearing device and scaled according to an interaural level difference determined in the left hearing device. If the noise signal is the equalized-cancelled environment sound signal of the left hearing device, the noise signal is transmitted to the right hearing device, where it is time delayed according to a time delay determined in the right hearing device and scaled according to an interaural level difference determined in the right hearing device. Preferably, the overall level of the noise signal is reduced in order to improve a signal-to-noise ratio (SNR) in both a left output sound signal and a right output sound signal.

The electric circuitry can be configured to apply the time delay to the noise signal. Preferably the electric circuitry is configured to reduce the overall level of the noise signal. The electric circuitry can be configured to combine the noise signal and the target signal to generate an output sound signal or add the noise signal to an output sound signal comprising the target signal to generate an output sound signal comprising the target signal and the noise signal. One electric circuitry can also be configured to provide an output sound signal to the output transducer of one of the hearing devices and the other electric circuitry can be configured to provide a noise signal to the output transducer on the other one of the hearing devices.

In a preferred embodiment, the electric circuitry of each of the hearing devices is configured to determine a gain in each time-frequency region based on the energy of the target signal or on the signal-to-noise ratio (SNR) of the target signal and the noise signal. The time-frequency regions are defined by the time steps (related to a length of a time frame/window) and frequency channels. Preferably, the electric circuitry is configured to apply the gain to the environment sound signal generating an output sound signal. Preferably, a high gain is applied in time-frequency regions where the target signal is above a certain threshold and a low gain in time-frequency regions where the target signal is below a certain threshold. This removes time-frequency regions with noise and keeps time-frequency regions with target signal, therefore removing most of the noise. The gain can also be applied as a function of energy of the target signal and time-frequency region, i.e., with the gain depending on the value of the energy of the target signal. Various aspects of 'time-frequency masking' are disclosed in EP2088802A1.

In an embodiment, an electric circuitry of the respective first and second hearing devices is configured to apply a level and/or frequency dependent gain to a resulting signal of the hearing device in question, before its presentation to the user to compensate for a hearing impairment of the user.

In one embodiment, the link unit of each of the hearing devices is a wireless link unit, e.g., comprising a Bluetooth transceiver, an infrared transceiver, a wireless data transceiver or the like. The wireless link unit is preferably configured to transmit and receive sound signals and data signals, e.g., environment sound signals, processed environment sound signals, equalized-cancelled sound signals, processed equalized-cancelled sound signals, auto-correlation functions, cross-correlation functions, gain functions, scaling parameters, pitches, pitch strengths or the like via a wireless link between the wireless link unit of one hearing device and the wireless link unit of the other hearing device of the binaural hearing system. Alternatively or additionally, the link unit can comprise a wired link, e.g. comprising a cable, a wire, or the like between the two link units of the binaural hearing system, which is configured to transmit and receive sound signals and data signals. The wired link can for example be enclosed in a pair of glasses, a frame of a pair of glasses, a hat, a head band, or other devices obvious to the person skilled in the art.

In a preferred embodiment, the environment sound input of each of the hearing devices is a microphone. Preferably, a left microphone is configured to receive sound and generate a left microphone signal at a left side of the binaural hearing system and a right microphone is configured to receive sound and generate a right microphone signal at a right side of the binaural hearing system.

In the present context, a 'hearing device' refers to a device, such as e.g. a hearing aid or hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nee of the user.

The objective of the disclosure is further achieved by a method for processing of binaural sound signals. The method comprises the following steps: a) Receiving a first environment sound signal (at a first ear) and a second environment sound signal (at a second ear). b) Processing the first environment sound signal and the second environment sound signal by generating processed first environment sound signals and processed second environment sound signals (at the first and second ears) wherein each of the processed first environment sound signals and processed second environment sound signals corresponds to a frequency channel. C) Using the processed first and second environment sound signals to estimate a respective time delays (at the first and second ears) between the processed first and second environment sound signals. In an embodiment, the method comprises determining a cross-correlation function between the processed second environment sound signals and the processed first environment sound signals as a function of the delay of the processed first environment sound signals in order to determine a first time delay, which is the time delay in the second hearing device (at the second ear) of a sound source coming from a same side as the processed first environment sound signals. In an embodiment, the method comprises determining a cross-correlation function between the processed first environment sound signals and the processed second environment sound signals as a function of the delay of the processed second environment sound signals in order to determine a second time delay, which is the time delay in the first hearing device (at the first ear) of a sound source coming from a same side as the processed second environment sound signals. Alternatively, the first and second time delay can also be determined after summing all the cross-correlation functions. The method further comprises d1) Applying the second time delay to the second environment sound signal to generate a time delayed second environment sound signal. d2) Applying the first time delay to the first environment sound signal to generate a time delayed first environment sound signal. In an embodiment, the method comprises scaling the time delayed second environment sound signal by a second interaural level difference to generate an equalized second environment sound signal. Scaling the time delayed first environment sound signal by a first interaural level difference to generate an equalized first environment sound signal. The method further comprises e) Subtracting the equalized (time delayed, and optionally scaled) second environment sound signal from the first environment sound signal to receive an equalized-cancelled first environment sound signal. Subtracting the equalized (time delayed, and optionally scaled) first environment sound signal from the second environment sound signal to receive an equalized-cancelled second environment sound signal.

It is intended that some or all of the structural features of the system described above, the 'detailed description of embodiments' or in the claims can be combined with embodiments of the method, when appropriately substituted by a corresponding process and vice versa. Embodiments of the method have the same advantages as a corresponding system.

In embodiment, the method comprises that first and second hearing devices (of a binaural hearing system) located at first and second ears, respectively, of a user receive (or pick up) and process the first and second environment sound signals, respectively. Typically, an environment sound signal received and optionally processed in one hearing device (at one ear) is made available in (e.g. by transmission to) the other hearing device (at the other ear), or to a third common processing device, for further processing (e.g. comparison, feature extraction, presentation, etc.).

In an embodiment, the method comprises using the equalized-cancelled first environment sound signal to generate a first output sound signal. In an embodiment, the method comprises using the equalized-cancelled second environment sound signal to generate a second output sound signal. In an embodiment, the equalized-cancelled first and second environment sound signals are used to generate the first and second output sound signals (e.g. by converting the equalized-cancelled environment sound signals directly to respective output sounds or by deriving parameters from the equalized-cancelled environment sound signals, which parameters are used to determine the respective output sound signals (of the first and second hearing devices) presented at the first and second ears).

This above mentioned delay is a part of the calculation in the respective hearing device. In an embodiment, the hearing device generates a cross-correlation function which is defined for a range of different delays. This function is e.g. obtained by shifting one of the signals by one sample at the time and for each shift calculating the cross correlation. In an exemplary case, it is the processed first environment sound signal that is shifted/delayed in order to calculate the delay of the first sound source in the second hearing device.

In one embodiment of the method, the first output sound signal is the equalized-cancelled first environment sound signal, and the second output sound signal is the equalized-cancelled second environment sound signal.

In an embodiment, the method comprises (dynamically) determining a (current) target and/or a noise signal based on the equalized-cancelled first and second environment sound signals (or signals derived therefrom). In an embodiment, a (current) target and/or a noise signal is determined based on analysis of the equalized-cancelled first and second environment sound signals in the frequency domain, e.g. in a number of frequency bands or channels.

In a preferred embodiment of the method using the equalized-cancelled first environment sound signal and equalized-cancelled second environment sound signal comprises the steps of A1) Processing the equalized-cancelled first environment sound signal by generating processed equalized-cancelled first environment sound signals with each of the processed equalized-cancelled first environment sound signals corresponding to a frequency channel. A2) Processing the equalized-cancelled second environment sound signal by generating processed equalized-cancelled second environment sound signals with each of the processed equalized-cancelled second environment sound signals corresponding to a frequency channel. B1) Determining an auto-correlation function of the processed equalized-cancelled first environment sound signals in each frequency channel and determining an auto-correlation function of the processed equalized-cancelled second environment sound signals in each frequency channel. B2) Determining a first summed auto-correlation function of the processed equalized-cancelled first environment sound signals of each frequency channel by summing the auto-correlation function of the processed equalized-cancelled first environment sound signals of each frequency channel across all frequency channels, and determining a second summed auto-correlation function of the processed equalized-cancelled second environment sound signals of each frequency channel by summing the auto-correlation function of the processed equalized-cancelled second environment sound signals of each frequency channel across all frequency channels. B3) Determining a pitch from a lag of a largest peak in the first summed auto-correlation function and the second summed auto-correlation function. The pitch can also be determined by other methods known in the art. B4) Determining a pitch strength by the peak-to-valley ratio of the largest peak. The pitch strength can also be determined by other methods known in the art. C1) Determining a target signal as the equalized-cancelled first environment sound signal (or a processed version thereof) or equalized-cancelled second environment sound signal (or a processed version thereof) with the strongest pitch (largest pitch strength). And C2) determining a noise signal as the equalized-cancelled first environment sound signal or equalized-cancelled second environment sound signal with the weakest pitch (smallest pitch strength).

A preferred embodiment of the method comprises the step of determining a gain in each time-frequency region based on the energy of the target signal or based on the signal-to-noise ratio (SNR) between the target signal and the noise signal. Preferably, it also comprises the step of applying the gain to the first environment sound signal to generate a first output sound signal and applying the gain to the second environment sound signal to generate a second output sound signal.

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

In an aspect, a data processing system comprising a processor and program code means for causing the processor to perform at least some (such as a majority or all) of the steps of the method described above, in the 'detailed description of embodiments' and in the claims is furthermore provided by the present application.

An embodiment of a binaural hearing system can be used to perform an embodiment of a method for processing of binaural sound signals.

The present disclosure will be more fully understood from the following detailed description of embodiments thereof, taken together with the drawings in which.

Figure 5:
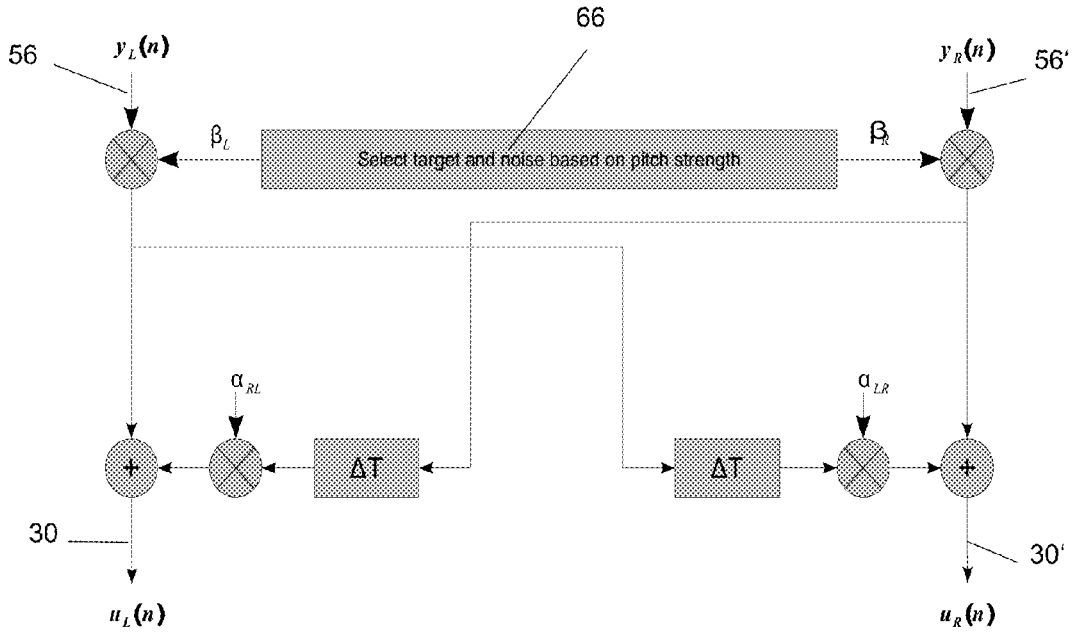
Figure 6A:
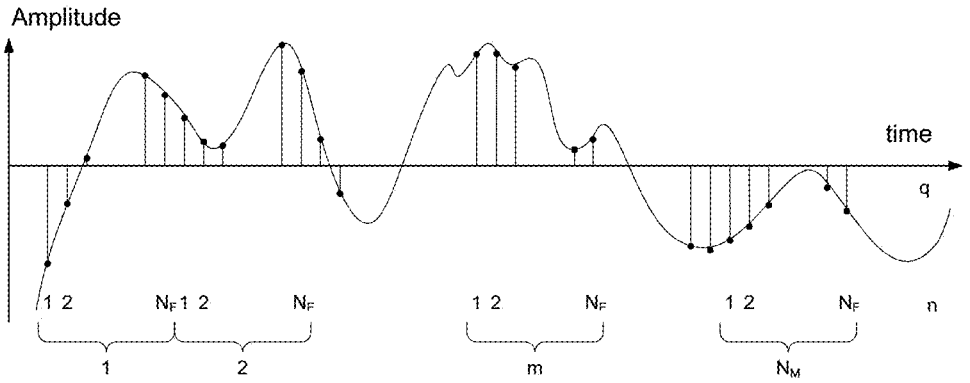
Figure 6B:
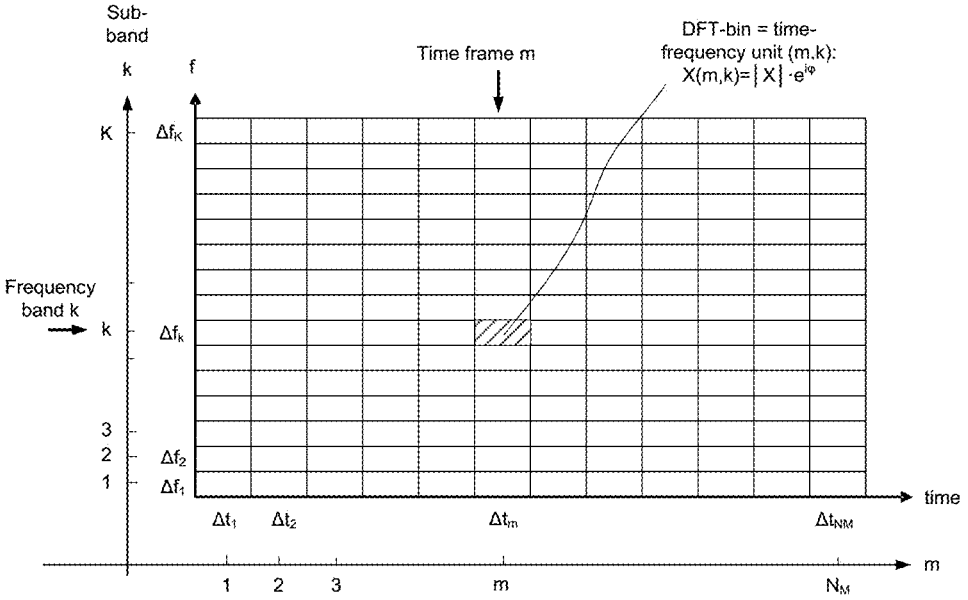

FIG. 5 shows an example of the use/processing of the equalized-cancelled microphone signals in the left and right hearing devices; and FIGS. 6A-6B schematically illustrate a conversion of a signal in the time domain to the time-frequency domain, FIG. 6A illustrating a time dependent sound signal (amplitude versus time) and its sampling in an analogue to digital converter, FIG. 6B illustrating a resulting 'map' of time-frequency units or ranges after a (short-time) Fourier transformation (or filtering) of the sampled signal.

Figure 1:
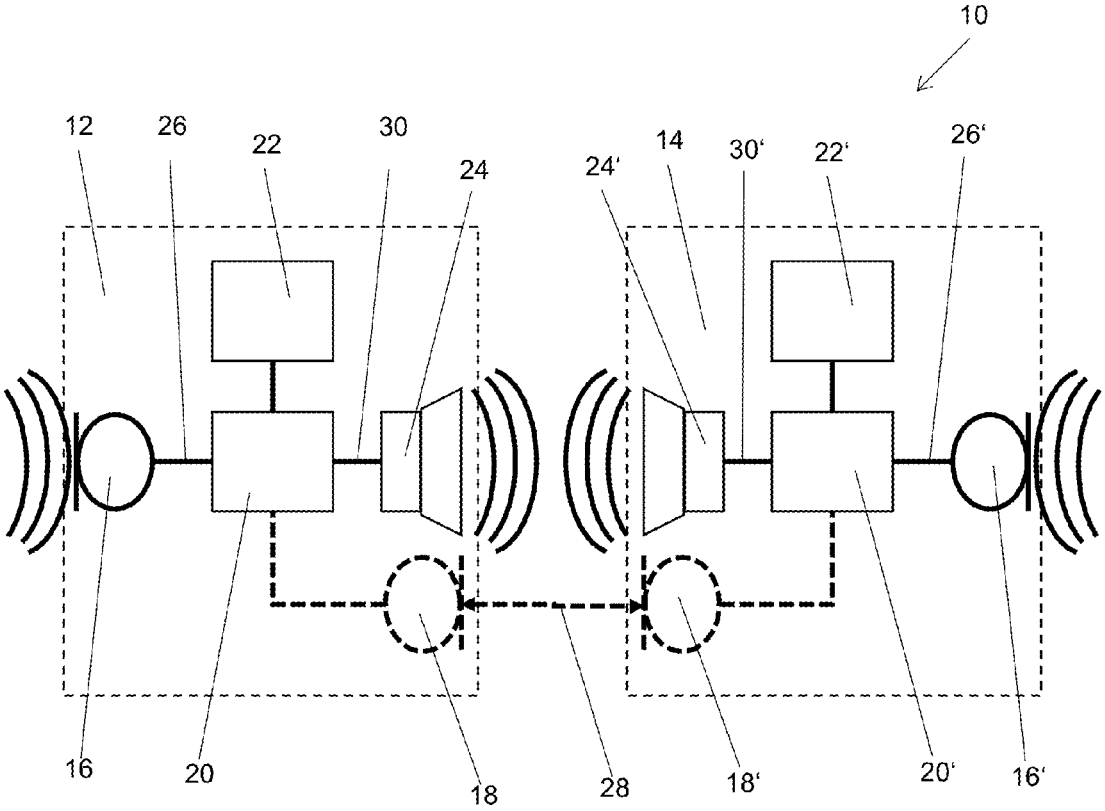
FIG. 1 shows a schematic illustration of a binaural hearing system.

FIG. 1 shows a binaural hearing system 10 with a left (e.g. first) hearing device 12 and a right (e.g. second) hearing device 14. Each of the hearing devices 12 and 14 has a microphone 16, 16', a Bluetooth transceiver 18, 18', electric circuitry 20, 20', a power source 22, 22', and a speaker 24, 24'.

The microphone 16 receives ambient (environment) sound from the environment on the left side of the binaural hearing system 10 and converts the ambient sound into a left microphone signal 26. The microphone 16' receives ambient (environment) sound from the environment on the right side of the binaural hearing system 10 and converts the ambient sound into a right microphone signal 26'. The Bluetooth transceiver 18 is connected wirelessly to the Bluetooth transceiver 18' via a link 28. The link can also be a wired link, e.g., a cable or wire and the Bluetooth transceiver 18, 18' can also be any other form of transceiver, e.g., Wi-Fi, infrared, or the like. The Bluetooth transceiver 18 transmits the left microphone signal 26 to the Bluetooth transceiver 18' and receives the right microphone signal 26' from the Bluetooth transceiver 18'. The electric circuitries 20 and 20' process the left and right microphone signals 26 and 26' and generate output sound signals 30 and 30', which are converted into output sound by the speakers 24 and 24'.

Figure 2:
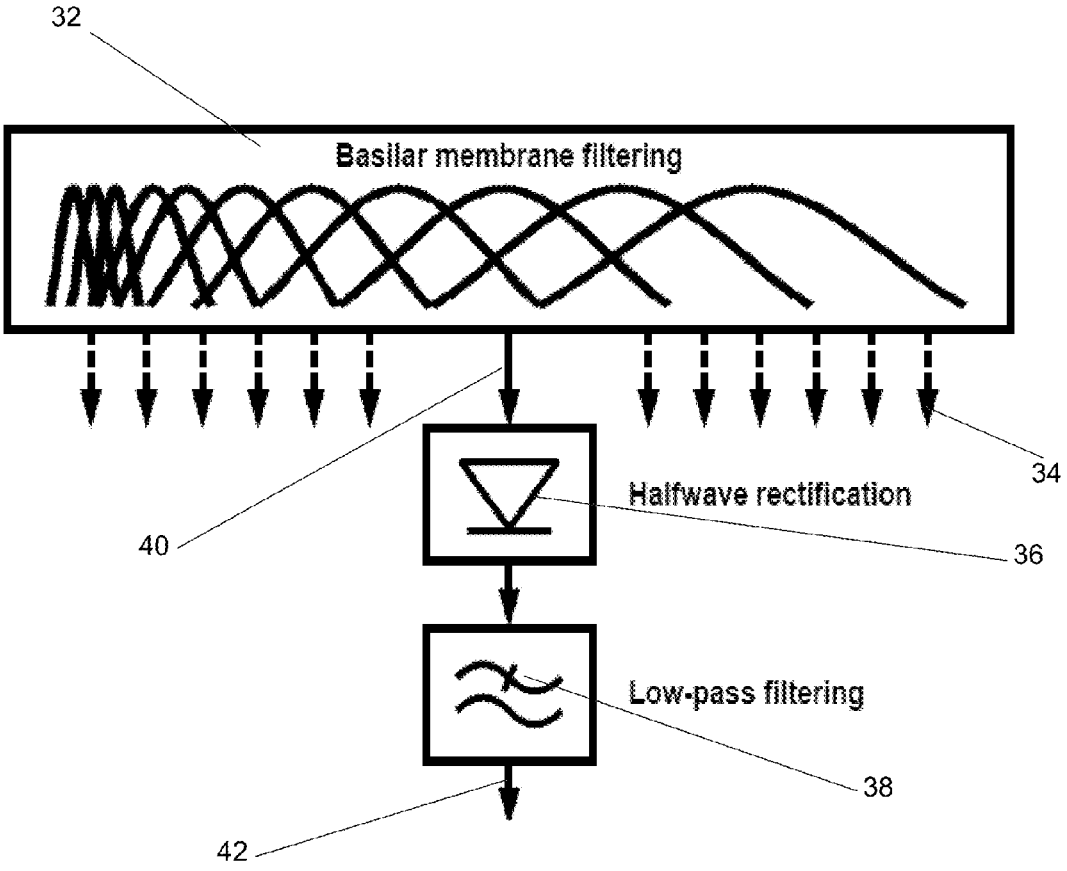
FIG. 2 shows a schematic illustration of a block diagram of an auditory pre-processing stage.

The method of processing of binaural sound signals can be performed by the binaural hearing system 10 presented in FIG. 1. An embodiment of the method can be divided into three stages: an auditory pre-processing stage (FIG. 2), an equalization and cancellation stage (FIG. 3), and a target selection and gain calculation stage (FIG. 4). The gain calculation can be optional. In the following, we will describe the method of processing of binaural sound signals in the hearing devices 12 and 14. The method for the right hearing device 14 in this embodiment is synchronously performed to the method of the left hearing device 12. In other embodiments different methods can be performed in the left hearing device 12 and in the right hearing device 14, e.g., not all of the steps of the method have to be the same. It is also possible to have a time delay between performing a method in the left hearing device 12 and the right hearing device 14.

In the auditory pre-processing stage (FIG. 2) the left microphone signal 26 and the right microphone signal 26', are divided into a number of frequency channels using a filter bank 32 with a number of band-pass filters 34, which are followed by a rectifier 36 and a low-pass filter 38. The band-pass filters 34 process a copy of the left microphone signal 26 and the right microphone signal 26' by dividing the respective signal into frequency channels through band-pass filtering with center frequencies corresponding to a specific band-pass filter 34. The center frequencies of the band-pass filters 34 are preferably between 0 Hz and 8000 Hz, e.g. non-linearly distributed, e.g. so that a difference between center frequencies of neighbouring band-pass filters increases with increasing frequency, as schematically indicated in the filter bank box 32 denoted 'Basilar membrane filtering'). The respective band-pass-filtered microphone signal 40, respectively 40' (not shown), in one of the frequency channels is half-wave rectified by the rectifier 36 and low-pass filtered by the low-pass filter 38 in order to extract periodicities below a certain cut-off frequency of the low-pass filter 38 to generate a processed microphone signal 42, respectively 42' (cf. FIG. 3). For frequency channels with low center frequencies the extracted periodicity corresponds to a temporal fine structure (TFS) of the signal while it corresponds to the envelope of the signal for frequency channels with higher center frequencies.

Figure 3:
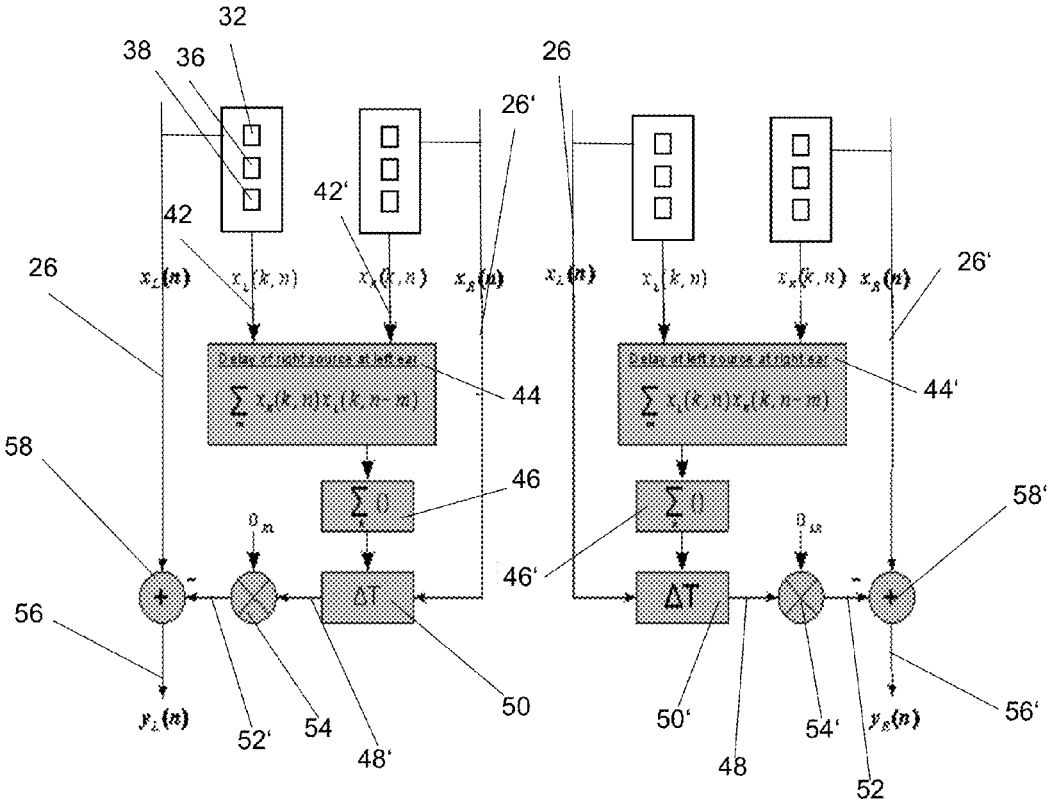
FIG. 3 shows a block diagram of an equalization and cancellation stage.
Figure 4:
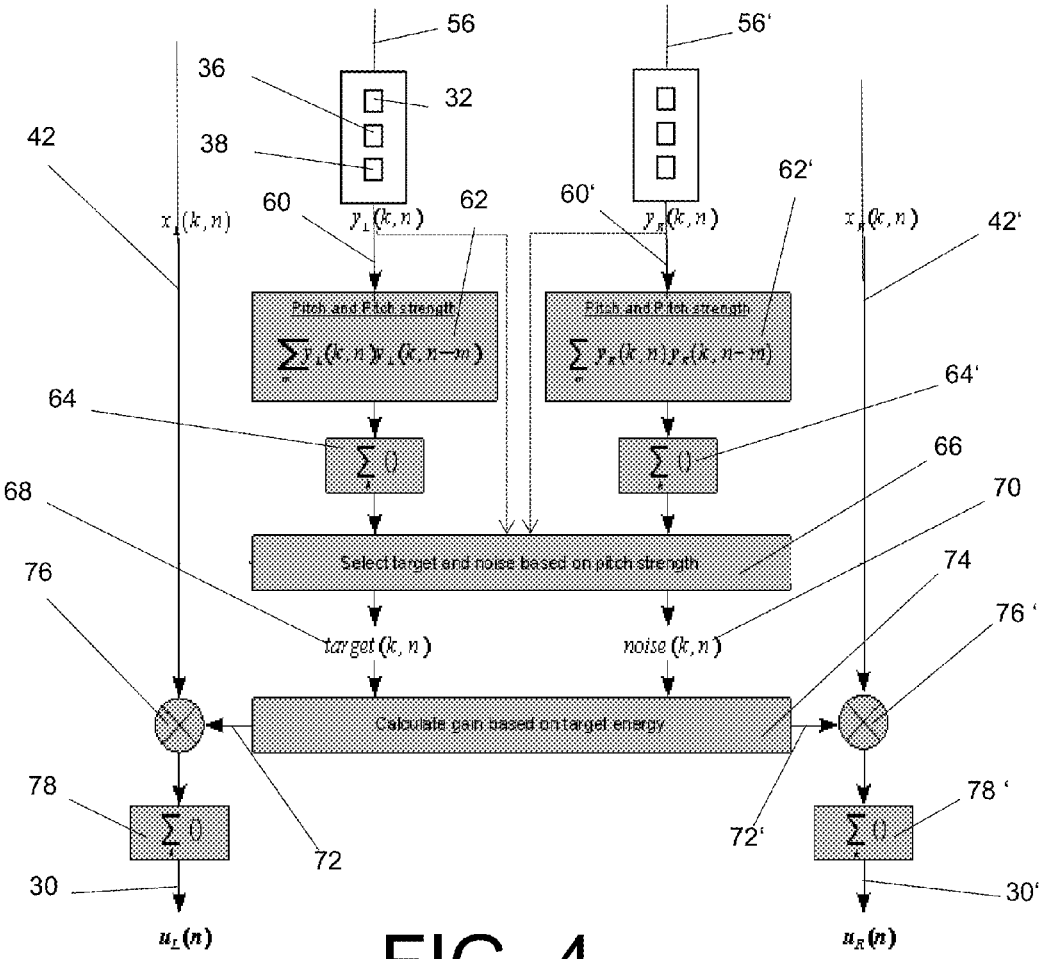
FIG. 4 shows a block diagram of a target selection and gain calculation stage.

FIG. 3 illustrates a part of the processing of the respective electric circuitries of the left (first) and right (second) hearing devices, respectively (as shown in the left and right parts, respectively, of FIG. 3). FIG. 3 illustrates the generation of equalized-cancelled first (left) and second (right) environment sound signals (signals $y_L$(56), $y_R$(56'), respectively, in FIG. 3) in the left and right hearing devices (i.e. to provide said signals in the left and right hearing devices, respectively, wherein sounds in the left ear (left hearing device) which are coming from the right side of the listener, and sounds in the right ear (right hearing device) which are coming from the left side of the listener, (ideally) are cancelled. The resulting equalized-cancelled first (left) and second (right) environment sound (microphone) signals $y_L(n)$ (56), $y_R$(56') are in the embodiment of FIG. 3 indicated to be time domain signals (time index n) generated from first and second environment sound (microphone) signals $x_L(n)$ (26), $x_R(n)$ (26') in the time domain, based on analysis of the first and second environment sound signals $x_L(k,n)$ (42), $x_R(k,n)$ (42'), in the time-frequency domain (frequency and time indices k, n). Alternatively, all signals on FIG. 3 may be in the time-frequency diomain.

In the equalization and cancellation stage (FIG. 3) a cross-correlation function between the processed left 42 and processed right microphone signals 42' is determined in each frequency channel. The cross-correlation function is either determined on a frame base or continuously. The determination of the cross-correlation function is divided in time steps determined by the time frame step size or a predefined time step duration for the continuously (running) cross-correlation function determination. The cross-correlation function can be determined in a cross-correlation unit 44 (44') or by an algorithm which is performed by the electric circuitry 20 (20'). Exemplary cross-correlation units 44 and 44' in FIG. 3 are denoted Delay of right source at left ear and Delay of left source at right ear, respectively, with corresponding equations for the cross-correlation functions $\rho_{LR}$, $\rho_{LR}$:

$$\rho_{LR}(k) = \sum_m x_L(k, n)x_R(k, n-m)$$

$$\rho_{RL}(k) = \sum_m x_R(k, n)x_L(k, n-m)$$

where m is a time index, are likewise indicated. It is assumed that the respective cross-correlation functions ($\rho_{LR}$, $\rho_{RL}$) are determined for each frequency band/channel, as indicated by the dependence of $\rho_{LR}$, $\rho_{RL}$ on frequency index k.

A time delay in each frequency channel is estimated as the lag of the largest peak or from the peak with the smallest lag. A right time delay is determined based on the cross-correlation function between the processed left microphone signal 42 ($x_L(k,n)$, where k and n are frequency and time indices, respectively) and the processed right microphone signal 42' ($x_R(k,n)$) as a function of the delay of the processed right microphone signal 42'. A left time delay is determined based on the cross-correlation function between the processed right microphone signal 42' ($x_R(k,n)$) and the processed left microphone signal 42 ($x_L(k,n)$) as a function of the delay of the processed left microphone signal 42. At each time step, the respective time delay between the processed left microphone signal 42 and the processed right microphone signals 42' is determined as an average across all frequency channels. The time delay can be determined by a time delay averaging unit 46 (46', both denoted $\Sigma_k(\ )$) or by an algorithm which is performed by the electric circuitry 20 (20'). The time delay is updated slowly over time. Alternatively, the first and second time delay is determined after summing the cross-correlation functions of the frequency channels.

In an embodiment, the hearing device generates a cross-correlation function which is defined for a range of different delays. This function is e.g. obtained by shifting one of the signals by one sample at the time and for each shift calculating the cross correlation. In this case it is the processed first environment sound signals that is shifted/delayed in order to calculate the delay of the first sound source at the second hearing device.

The left time delay is then applied to the left microphone signal 26 at the right side and the right time delay is then applied to the right microphone signal 26' at the left side generating a time delayed left microphone signal 48 at the right side and a time delayed right microphone signal 48' at the left side. Applying the left and/or right time delay can be performed by a time delay application unit 50 (50', both denoted ΔT) or by an algorithm which is performed by the electric circuitry 20 (20').

Preferably the left microphone signal 26 ($x_L(n)$) at the right side is scaled by an interaural level difference (cf. scaling unit 54' and multiplication factor $\alpha_{LR}$ in FIG. 3) determined by the right hearing device 14 and the right microphone signal 26' at the left side is scaled by an interaural level difference (cf. scaling unit 54 and multiplication factor $\alpha_{RL}$ in FIG. 3) determined by the left hearing device 12 resulting in an equalized left microphone signal 52 and an equalized right microphone signal 52' in the right (14) and left (12) hearing devices, respectively. In this embodiment each of the interaural level differences determined by the left hearing device 12 and right hearing device 14 is determined from a lookup table (e.g. stored in the respective hearing devices) based on the time delay determined by the left nearing device 12 and right hearing device 14 and thereby the direction of the sound. In an embodiment, the interaural level differences determined by the left hearing device 12 and right hearing device 14 correspond to the level differences of masking components, e.g., noise or the like, between the left and right side. The interaural level difference can also correspond to the level difference of target components. The scaling can be performed by a scaling unit 54 (54', e.g. multiplication units) or by an algorithm which is performed by the electric circuitry 20 (20').

The equalized right microphone signal 52' is then subtracted (cf. SUM unit 58) from the left microphone signal 26 ($x_L(n)$) at the left side generating an equalized-cancelled left microphone signal 56 ($y_L(n)$) and the equalized left microphone signal 52 is then subtracted (cf. SUM unit 58') from the right microphone signal 26' ($x_R(n)$) at the right side generating an equalized-cancelled right microphone signal 56' ($y_R(n)$). The subtraction can be performed by a signal addition unit 58 (58') or by an algorithm which is performed by the electric circuitry 20 (20').

After this stage the equalized-cancelled microphone signals 56, 56' generated through the equalization-cancellation stage could in principle be presented to a listener by hearing devices 12 and 14 (FIG. 1), but the equalized-cancelled microphone signals 56, 56' do not comprise any spatial cues. The equalized-cancelled microphone signals 56, 56' have an improved left sound signal in the left ear and an improved right sound signal in the right ear, as masking components have been removed. The spatial cues can also be regained in the target selection and gain calculation stage (see later, e.g. FIG. 5). Also, a noise signal can be generated by the equalization-cancellation stage, if the interaural level difference corresponds to the level difference of target components. If a noise signal and a target signal are generated, preferably one hearing device will have (generate) the target signal and the other hearing device will have (generate) the noise signal. Basically, the left hearing device cancel out sound coming from the right and the right hearing device cancel out sound coming from the left. Thus, if the target is coming from the left, the left hearing device will have the target signal and the right hearing device will have the masker (noise) signal.

In the target selection and gain calculation stage (cf. FIG. 4), the target signal and a gain based on the target signal are determined. The stage begins with determining which of the equalized-cancelled left microphone signal 56 or equalized-cancelled right microphone signals 56' is the target signal (cf. also block 66 in FIG. 5).

The target signal 68 (target(k,n)) is preferably determined as the equalized-cancelled microphone signal 56, 56' with the strongest pitch. To determine the equalized-cancelled microphone signal 56, 56' with the strongest pitch the auditory pre-processing stage using the filter bank 32 with band-pass filters 34, the rectifier 36, and the low-pass filter 38 is performed on each of the equalized-cancelled microphone signals 56 ($y_L(n)$), 56' ($y_R(n)$) (in the time-domain) generating processed equalized-cancelled microphone signals 60 ($y_L(k,n)$), 60' ($y_R(k,n)$) (in the time-frequency domain) (cf. FIG. 4). An auto-correlation function of the respective processed equalized-cancelled microphone signal 60, 60' is determined for short time frames or by using sliding windows in each frequency channel. Determining the auto-correlation can be performed by an auto-correlation unit 62, 62' or by an algorithm which is performed by the electric circuitry 20 (20', cf. FIG. 1). Exemplary auto-correlation units 62 and 62' in FIG. 4 are denoted Pitch and Pitch strength with corresponding respective equations for the auto-correlation functions $R_{LL}$, $R_{RR}$:

$$R_{LL}(k) = \sum_m y_L(k, n) y_L(k, n-m)$$

$$R_{RR}(k) = \sum_m y_R(k, n) y_R(k, n-m)$$

where m is a time index, are likewise indicated. It is assumed that the respective auto-correlation functions ($R_{LL}$, $R_{RR}$) are determined for each frequency band/channel, as indicated by the dependence of $R_{LL}$, $R_{RR}$ on frequency index k.

At each time step the auto-correlation functions are summed across all frequency channels and a pitch is determined from the lag of the largest peak in the summed auto-correlation function. The pitch strength is determined by the peak-to-valley ratio of the largest peak. The pitch and pitch strength are e.g. updated slowly across time. The summation of the auto-correlation functions and determination of the pitch and pitch strength can be performed by a summation and pitch determination unit 64 (64', both denoted $\Sigma_k(\,)$ in FIG. 4) or by an algorithm which is performed by the electric circuitry 20 (20', cf. FIG. 1).

Finally, the target signal 68 (target(k,n)) is chosen as the processed equalized-cancelled microphone signal 60, 60' with the strongest pitch. The noise signal 70 (noise(k,n)) is chosen as the processed equalized-cancelled microphone signal 60, 60' with the weakest pitch. The target and noise selection can be performed by a target selection unit 66 (denoted Select target and noise based on pitch strength in FIG. 4) or by an algorithm which is performed by the electric circuitry 20 (20').

An example of the further use/processing of the equalized-cancelled microphone signals 56, 56' (FIG. 3) in the left and right hearing devices 12, 14 is illustrated in FIG. 5.

In order to determine the target signal 68 and noise signal 70 the pitch and pitch strength of the left hearing device 12 is transmitted to the right hearing device 14 and vice versa. The pitch strength of the respective equalized-cancelled microphone signal 56 or 56' is compared to the transmitted pitch strength of the equalized-cancelled microphone signal 56' or 56 and depending on the result, meaning which signal has the strongest/weakest pitch, the following steps are performed (cf. block 66 in FIG. 4, 5).

If the target signal 68 (target(k,n), cf. FIG. 4) is the processed equalized-cancelled left microphone signal 60 ($y_L(k,n)$), meaning that the equalized-cancelled left microphone signal 56 ($y_L(n)$) has the strongest pitch, the equalized-cancelled left microphone signal 56 is transmitted to the right hearing device 14 where it is time delayed (cf. blocks ΔT in FIG. 5) according to the time delay determined in the right hearing device 14 and scaled according to the interaural level difference determined in the right hearing device 14 (cf. multiplication factors $\alpha_{LR}$ in FIG. 5) generating a right output sound signal 30' ($u_R(n)$). The left output sound signal 30 ($u_L(n)$) is the equalized-cancelled left microphone signal 56 ($y_L(n)$, $\alpha_{RL}=0$ in FIG. 5).

If the target signal 68 (target(k,n)) is the processed equalized-cancelled right microphone signal 60' ($y_R(k,n)$), meaning that the equalized-cancelled right microphone signal 56' ($y_R(n)$) has the strongest pitch, the equalized-cancelled right microphone signal 56' is transmitted to the left hearing device 12 were it is time delayed (cf. blocks ΔT in FIG. 5) according to the time delay determined in the left hearing device 12 and scaled according to the interaural level difference determined in the left hearing device 12 (cf. multiplication factors $\alpha_{RL}$ in FIG. 5) generating a left output sound signal 30 ($u_L(n)$). The right output sound signal 30' ($u_R(n)$) is the equalized-cancelled right microphone signal 56' ($y_R(n)$, $\alpha_{LR}=0$ in FIG. 5).

The left output sound signal 30 is converted to a left output sound at the left side and the right output sound signal 30' is converted to a right output sound at the right side (e.g. by respective output transducers, e.g. loudspeakers 24, 24' in FIG. 1). The conversion of output sound signal 30, 30' to output sound is preferably performed synchronously.

The noise signal (70, noise(k,n) in FIG. 4) can also be added to the output sound signals 30, 30' or used as one or both of the output sound signals 30, 30'.

If the noise signal 70 is the processed equalized-cancelled left microphone signal 60, the equalized-cancelled left microphone signal 56 is (or may be) transmitted to the right hearing device where it is time delayed according to the time delay determined in the right hearing device 14 and scaled according to the interaural level difference determined in the right hearing device 14 generating a right output sound signal 30'. The left output sound signal 30 is (or may be) the equalized-cancelled left microphone signal 56.

If the noise signal 70 is the processed equalized-cancelled right microphone signal 60', the equalized-cancelled right microphone signal 56' is (or may be) transmitted to the left hearing device where it is time delayed according to the time delay determined in the left hearing device 12 and scaled according to the interaural level difference determined in the left hearing device 12 generating a left output sound signal 30. The right output sound signal 30' is (or may be) the equalized-cancelled right microphone signal 56'.

Preferably, the noise signal, which can either be the equalized-cancelled left microphone signal 56 or the equalized-cancelled right microphone signal 56' (or a signal derived therefrom), is attenuated compared to the target signal. This attenuation is e.g. applied by $\beta_L$ (cf. multiplication unit in left side of FIG. 5) if the noise signal is determined as the equalized-cancelled left microphone signal 56 and by $\beta_R$ (cf. multiplication unit in right side of FIG. 5) if the noise signal is determined as the equalized-cancelled right microphone signal 56'.

If the target signal (68, 68') (cf. FIG. 4) is determined as the processed equalized-cancelled environment sound signal (60; 60') of the hearing device (12; 14), the hearing device in question (12; 14, e.g. the left (12)) is configured to apply a high gain, $\beta_L$, to the equalized-cancelled environment sound signal (56; 56') of the hearing device in question (12; 14) before it is provided to the link unit (18; 18') (of the hearing device in question), and the other hearing device (14; 12, e.g. the right (14)) is configured to apply a low gain, $\beta_R$, to the equalized-cancelled environment sound signal (56'; 56) of the other hearing device (14; 12) before it is provided to the link unit (18'; 18) (of the other hearing device).

In another preferred embodiment a gain 72 (72', cf. FIG. 4) in each time-frequency region (cf. DFT-bin (m,k) in FIGS. 6A-6B) is determined based on the energy of the target signal 68 or the signal-to-noise ratio (SNR) between the target signal 68 and the noise signal 70. The gain 72 (72') can be determined by a gain determination unit 74 (denoted Calculate gain based on target energy in FIG. 4) or by an algorithm which is performed by the electric circuitry 20 (20').

Preferably a high gain (e.g. >0.5. e.g. 1) is applied to the left microphone signal 42 ($x_L(k,n)$), respectively right microphone signal 42' ($x_R(k,n)$) in time-frequency regions where the target signal 68 is above a certain threshold or above a certain signal-to-noise ratio (SNR) between the target signal 68 (target(k,n)) and the noise signal 70 (noise(k,n)) and a low gain (e.g. <0.5, e.g. 0) is applied to the left 42, respectively right microphone signal 42' in time-frequency regions where the target signal 68 is below a certain threshold or below a certain signal-to-noise ratio (SNR) between the target signal 68 and the noise signal 70. Applying the gain 72 to the left microphone signal 42 and the gain 72' to the right microphone signal 42' generates a left output sound signal 30 ($u_L(k,n)$) and a right output sound signal 30' ($u_R(k,n)$). The left output sound signal 30 is preferably converted to a left output sound at the left side synchronously with a conversion of the right output sound signal 30' to a right output sound at the right side (after a time-frequency to time conversion, cf. units 78, 78' (both denoted $\Sigma_k(\ )$ in FIG. 4). In an embodiment, only time-frequency regions of the target signal 68 are kept and most of the noise is removed. The gain application can be performed by a gain application unit 76, 76' or by an algorithm which is performed by the electric circuitry 20 (20').

In this embodiment the processed microphone signals 42 ($x_L(k,n)$), 42' ($x_R(k,n)$) in the time-frequency domain with applied gain in the frequency channels are summed across all frequency channels to generate the output sound signals 30, 30' in the time domain. The summation of microphone signals with applied gain can be performed by a frequency channel summation unit 78, 78' (denoted $\Sigma_k(\ )$ in FIG. 4) or by an algorithm which is performed by the electric circuitry 20 (20').

FIG. 6A illustrates a time dependent sound signal x(t) (amplitude (SPL [dB]) versus time (t)), its sampling in an analogue to digital converter and a grouping of time samples in frames, each comprising $N_F$ samples. The graph showing a Amplitude versus time (solid line in FIG. 6A) may e.g. represent the time variant analogue electric signal provided by an input transducer, e.g. a microphone, before being digitized by an analogue to digital conversion unit. FIG. 6B illustrates a 'map' of time-frequency units resulting from a Fourier transformation (e.g. a discrete Fourier transform, DFT) of the input signal of FIG. 6A, where a given time-frequency unit (m,k) corresponds to one OFT-bin and comprises a complex value of the signal X(m,k) in question ($X(m,k)=|X|\cdot e^{i\Phi}$, |X|=magnitude and $\phi$=phase) in a given time frame m and frequency hand k. In the following, a given frequency band is assumed to contain one (generally complex) value of the signal in each time frame. It may alternatively comprise more than one value. The terms 'frequency range' and 'frequency band' are used in the present disclosure. A frequency range may comprise one or more frequency hands. The time-frequency map of FIG. 6B illustrates time frequency units (m,k) for k=1, 2, . . . , K frequency bands and m=1, 2, . . . $N_M$ time units. Each frequency band $\Delta f_k$ is indicated in FIG. 6B to be of uniform width. This need not be the case, though. The frequency hands may be of different width (or alternatively, frequency channels may be defined which contain a different number of uniform frequency bands, e.g. the number of frequency bands of a given frequency channel increasing with increasing frequency, the lowest frequency channel(s) comprising e.g. a single frequency band). The time intervals $\Delta t_m$ (time unit) of the individual time-frequency bins are indicated in FIG. 6B to be of equal size. This need not be the case though, although it is assumed in the present embodiments. A time unit $\Delta t_m$ is typically equal to the duration of the number $N_s$ of samples in a time frame (cf. FIG. 6A) times the length in time $t_s$ of a sample ($t_s=(1/f_s)$, where $f_s$ is a sampling frequency). A time unit is e.g. of the order of ms in an audio processing system.

REFERENCE SIGNS

10 binaural hearing system
12 left hearing device
14 right hearing device
16 microphone
18 Bluetooth transceiver
20 electric circuitry
22 power source
24 speaker
26 microphone signal
28 link
30 output sound signal
32 filter bank
34 band-pass filter
36 rectifier
38 low-pass filter
40 band-pass filtered microphone signal
42 processed microphone signal
44 cross-correlation unit
46 time delay averaging unit
48 time delayed microphone signal
50 time delay application unit
52 equalized microphone signal
54 scaling unit
56 equalized-cancelled microphone signal
58 signal addition unit
60 processed equalized-cancelled microphone signal
62 auto-correlation unit
64 summation and pitch determination unit
66 target selection unit
68 target signal
70 noise signal
72 gain
74 gain determination unit
76 gain application unit
78 frequency channel summation unit

The invention claimed is:

1. A binaural hearing system comprising at least a first hearing device and a second hearing device, each comprising a power source, an environment sound input for sound from an acoustic environment, which is configured to generate an environment sound signal, a link unit, which is configured to transmit the environment sound signal from the hearing device comprising the link unit to a link unit of the other hearing device of the binaural hearing system and to receive a transmitted environment sound signal from the other hearing device of the binaural hearing system, and electric circuitry comprising a filter bank, which is configured to process the environment sound signal and the transmitted environment sound signal or signals derived therefrom by generating processed environment sound signals and processed transmitted environment sound signals, wherein each of the processed environment sound signals and processed transmitted environment sound signals corresponds to a frequency channel determined by the filter bank, wherein each of the electric circuitries is configured to use the environment sound signals and/or the processed environment sound signals of the respective hearing device and the transmitted environment sound signals and/or the processed transmitted environment sound signals from the other hearing device to estimate a respective time delay between the environment sound signal and the transmitted environment sound signal, to apply the respective time delay to the transmitted environment sound signal to generate a time delayed transmitted environment sound signal, to scale the time delayed transmitted environment sound signal by a respective interaural level difference to generate an equalized transmitted environment sound signal, to subtract the equalized transmitted environment sound signal from the environment sound signal to provide an equalized-cancelled environment sound signal, and to dynamically determine a target and/or a noise signal based on an analysis of the equalized-cancelled first and second environment sound signals.

2. A binaural hearing system according to claim 1, wherein each of the filter banks comprises a number of band-pass filters configured to divide the environment sound signal and transmitted environment sound signal into a number of environment sound signals and transmitted environment sound signals each corresponding to a frequency channel determined by one of the band-pass filters, and each of the electric circuitries comprises a rectifier configured to half-wave rectify the environment sound signals and transmitted environment sound signals in the frequency channels and a low-pass filter configured to low-pass filter the environment sound signals and transmitted environment sound signals in the frequency channels, and wherein each of the electric circuitries is configured to generate processed environment sound signals and processed transmitted environment sound signals in the frequency channels by using the filter bank, the rectifier, and the low-pass filter.

3. A binaural hearing system according to at least one of the claim 1, wherein each of the electric circuitries is configured to determine a cross-correlation function between the processed environment sound signals and the processed transmitted environment sound signals of each of the frequency channels, wherein each of the electric circuitries is configured to sum the cross correlation functions of each of the frequency channels and to estimate a time delay from the peak with smallest lag or from the lag of the largest peak of the summed cross-correlation functions.

4. A binaural hearing system according to claim 1, wherein each of the electric circuitries comprises a lookup table with a number of predetermined scaling factors each representing an interaural level difference corresponding to a time delay range and wherein the respective interaural level difference is determined by the lookup table in dependence of the respective time delay.

5. A binaural hearing system according to claim 4, wherein the predetermined scaling factors each corresponding to a time delay range are determined in a fitting step to determine the respective interaural level difference of masking sound between the two hearing devices of the binaural hearing system.

6. A binaural hearing system according to claim 1 wherein each of the electric circuitries of the first and second hearing devices is configured to dynamically determine a target and/or a noise signal from a pitch and a pitch strength of the equalized-cancelled first and second environment sound signals or signals derived therefrom.

7. A binaural hearing system according to claim 6 wherein each of the electric circuitries is configured to determine a target signal as the processed equalized-cancelled environment sound signal of the hearing device or the processed equalized-cancelled environment sound signal of the other hearing device with the strongest pitch.

8. A binaural hearing system according to claim 1 wherein each of the electric circuitries of the first and second hearing devices comprises one or more filter banks configured to convert a time domain signal into a number of time-frequency domain signals representing the time domain signal in a number of frequency channels.

9. A binaural hearing system according to claim 1 wherein each of the electric circuitries of the first and second hearing devices is configured to provide the equalized-cancelled environment sound signal of the respective hearing device in the time-frequency domain represented by processed equalized-cancelled environment sound signals in a number of frequency channels.

10. A binaural hearing system according to claim 9 wherein said analysis of the equalized-cancelled first and second environment sound signals is based on said processed equalized-cancelled environment sound signals.

11. A binaural hearing system according to claim 9 wherein each of the electric circuitries of the first and second hearing devices is configured to determine an auto-correlation function of the processed equalized-cancelled environment sound signals in each frequency channel, and to base said analysis thereon.

12. A binaural hearing system according to claim 11, wherein each of the electric circuitries is configured to determine a summed auto-correlation function of the processed equalized-cancelled environment sound signals across all frequency channels, to determine a pitch from a lag of a largest peak in the summed auto-correlation function, and to determine the pitch strength by the peak-to-valley ratio of the largest peak.

13. A binaural hearing system according to claim 11, wherein each of the electric circuitries is configured to provide the pitch and the pitch strength to their respective link unit, wherein the link unit is configured to transmit the pitch and the pitch strength to the link unit of the other hearing device of the binaural hearing system and to receive a pitch and a pitch strength from the other hearing device.

14. A binaural hearing system according to claim 1, wherein each of the electric circuitries of the first and second hearing devices is configured to transmit the target signal to the link unit of the other hearing device and wherein the electric circuitry of the other hearing device is configured to apply the respective time delay to the received target signal and, to scale the received target signal by a respective interaural level difference, generating respective output sound signals based thereon.

15. A binaural hearing system according to claim 1, wherein each of the electric circuitries is configured to represent the target signal and the noise signal in the time frequency domain by values of the signal in a number of time-frequency regions, and to determine a gain in each time-frequency region based on the energy of the target signal and the energy of the noise signal and to apply the gain to the environment sound signal, generating a respective output sound signal.

16. A binaural hearing system according to claim 1 wherein at least one of the first and second hearing devices comprises a hearing aid or hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears.

17. A binaural hearing system according to claim 1 wherein each of the first and second hearing devices comprises an output unit for providing a stimulus perceived by the user as an acoustic signal wherein the output unit comprises a number of electrodes of a cochlear implant or a vibrator of a bone conducting hearing device or a loudspeaker for providing the stimulus to the user as a sound.

18. A method for processing of binaural sound signals, comprising the steps:

receiving a first environment sound signal and a second environment sound signal, processing the first environment sound signal and the second environment sound signal by generating processed first environment sound signals and processed second environment sound signals wherein each of the processed first environment sound signals and processed second environment sound signals corresponds to a frequency channel, determining a respective time delay between the first environment sound signal and the second environment sound signal, applying the respective time delay to the second environment sound signal to generate a time delayed second environment sound signal and applying the respective time delay to the first environment sound signal to generate a time delayed first environment sound signal, scaling the time delayed second environment sound signal by a respective interaural level difference to generate an equalized second environment sound signal and scaling the time delayed first environment sound signal by a respective interaural level difference to generate an equalized first environment sound signal, subtracting the equalized second environment sound signal from the first environment sound signal to receive an equalized-cancelled first environment sound signal and subtracting the equalized first environment sound signal from the second environment sound signal to receive an equalized-cancelled second environment sound signal, and dynamically determining a target and/or a noise signal based on an analysis of the equalized-cancelled first and second environment sound signals.

19. A data processing system comprising a processor and non-transitory tangible recording medium encoded with instructions for causing the processor to perform a method comprising:

receiving a first environment sound signal and a second environment sound signal, processing the first environment sound signal and the second environment sound signal by generating processed first environment sound signals and processed second environment sound signals wherein each of the processed first environment sound signals and processed second environment sound signals corresponds to a frequency channel, determining a respective time delay between the first environment sound signal and the second environment sound signal, applying the respective time delay to the second environment sound signal to generate a time delayed second environment sound signal and applying the respective time delay to the first environment sound signal to generate a time delayed first environment sound signal, scaling the time delayed second environment sound signal by a respective interaural level difference to generate an equalized second environment sound signal and scaling the time delayed first environment sound signal by a respective interaural level difference to generate an equalized first environment sound signal, subtracting the equalized second environment sound signal from the first environment sound signal to receive an equalized-cancelled first environment sound signal and subtracting the equalized first environment sound signal from the second environment sound signal to receive an equalized-cancelled second environment sound signal, and dynamically determining a target and/or a noise signal based on an analysis of the equalized-cancelled first and second environment sound signals.

* * * * *